US008601727B2

(12) United States Patent
Feagins et al.

(10) Patent No.: US 8,601,727 B2
(45) Date of Patent: Dec. 10, 2013

(54) SELF-SUPPORTING SIGN AND METHOD OF MANUFACTURING SAME

(75) Inventors: Cecil J. Feagins, Fort Scott, KS (US); Cecil Lee Combs, Fort Scott, KS (US)

(73) Assignee: Ward Kraft, Inc., Fort Scott, KS (US)

( * ) Notice: Subject to any disclaimer, the term of this patent is extended or adjusted under 35 U.S.C. 154(b) by 147 days.

(21) Appl. No.: 12/984,419

(22) Filed: Jan. 4, 2011

(65) Prior Publication Data

US 2011/0209369 A1 Sep. 1, 2011

Related U.S. Application Data

(60) Provisional application No. 61/308,662, filed on Feb. 26, 2010, provisional application No. 61/348,389, filed on May 26, 2010.

(51) Int. Cl.
*G09F 1/00* (2006.01)

(52) U.S. Cl.
USPC ..... 40/124.16; 40/539

(58) Field of Classification Search
USPC ..... 40/124.16, 539, 124.14, 124.08, 40/611.13, 606.15
See application file for complete search history.

(56) References Cited

U.S. PATENT DOCUMENTS

| | | | | |
|---|---|---|---|---|
| 1,669,782 | A * | 5/1928 | Risser | 40/607.14 |
| 1,821,025 | A * | 9/1931 | Ohlson | 40/124.16 |
| 3,624,688 | A * | 11/1971 | Miller | 40/778 |
| 5,303,668 | A * | 4/1994 | Huang | 116/63 P |
| 2005/0172529 | A1 * | 8/2005 | Bourgoin et al. | 40/359 |

* cited by examiner

*Primary Examiner* — Joanne Silbermann
(74) *Attorney, Agent, or Firm* — Lathrop & Gage LLP

(57) ABSTRACT

Self-supporting signs and methods of manufacturing same are provided herein. In one embodiment, a self-supporting sign comprises a generally planar base portion and a generally planar upper portion extending from the base portion. The upper portion is foldable relative to the base portion about a fold line for movement between a storage configuration in which the base and upper portions are generally coplanar and a use configuration in which the base portion is generally horizontal and the upper portion is raised relative to the base portion. Only folding about the fold line is necessary to move from the storage configuration to the use configuration, and the base and upper portions are sufficiently rigid such that the upper portion remains at the use configuration after being moved to the use configuration. The upper portion may be offset from the base portion between about 50° and 90° when at the use configuration.

18 Claims, 7 Drawing Sheets

SELF-SUPPORTING SIGN AND METHOD OF MANUFACTURING SAME

RELATED APPLICATIONS

This application claims priority to U.S. Provisional Patent Application Ser. No. 61/308,662, filed Feb. 26, 2010, and U.S. Provisional Patent Application Ser. No. 61/348,389, filed May 26, 2010, the disclosures of which are incorporated herein by reference.

BACKGROUND

The invention relates generally to the field of signs. More particularly, the invention relates to the field of self-supporting signs such as those used in retail and corporate environments.

The prior art includes, for example, signs 10, 20 such as those shown in FIGS. 1 through 2*b*. While presumably sufficient for their intended purpose, the prior art signs 10, 20 suffer from various shortcomings. For example, the sign 10 requires use of a support 12 coupled to a base 11, and printed material 13 cannot stand on its own; it must be inserted in the support 12 (shown by arrow 15). The sign 20 can stand without having a separable base. However, to use the sign 20, the sign must first be folded about fold lines 21, 22, 23, and lower portions 24*a*, 24*b* must be coupled together (e.g., using adhesive, by mating tab 25*a* to slot 25*b*, etc.). Further, because of its configuration, relatively large amounts of material may be required to construct the sign 20.

SUMMARY

Self-supporting signs and methods of manufacturing same are provided herein. In one embodiment, a self-supporting sign comprises a unitary sheet having a base portion and an upper portion. The upper portion is foldable relative to the base portion about a fold line. The unitary sheet is sufficiently rigid such that when the upper portion is folded relative to the base portion about the fold line, the sign remains at a use configuration in which the base portion is generally horizontal and the upper portion is raised relative to the base portion. Only the single fold about the fold line is necessary to move the sign from a generally planar configuration to the use configuration.

In another embodiment, a self-supporting sign comprises a generally planar base portion and a generally planar upper portion extending from the base portion. The upper portion is foldable relative to the base portion about a fold line for movement between a storage configuration in which the base and upper portions are generally coplanar and a use configuration in which the base portion is generally horizontal and the upper portion is raised relative to the base portion. Only folding about the fold line is necessary to move from the storage configuration to the use configuration, and the base and upper portions are sufficiently rigid such that the upper portion remains at the use configuration after being moved to the use configuration.

DETAILED DESCRIPTION

Figure 1:
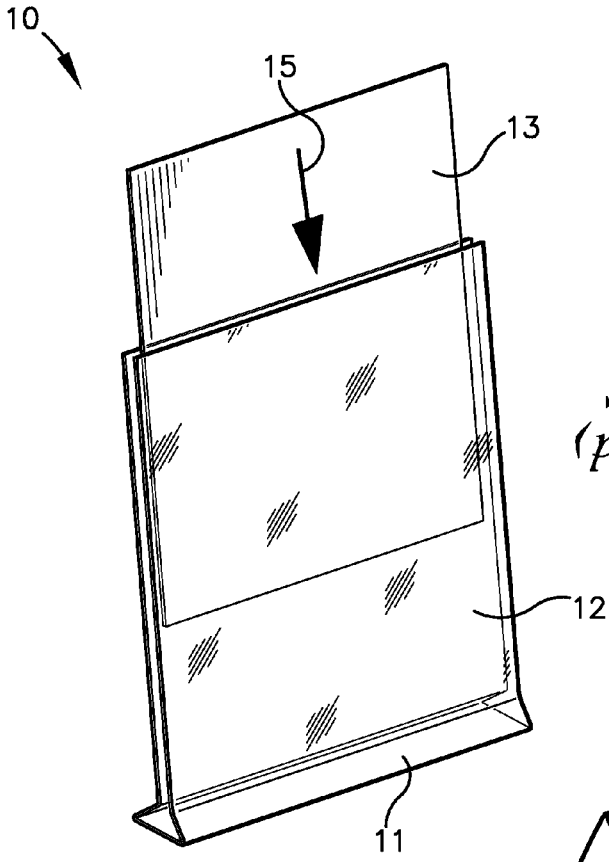
Fig. 1 (prior art)
FIG. 1 shows a perspective view of a PRIOR ART sign.
Figure 2A:
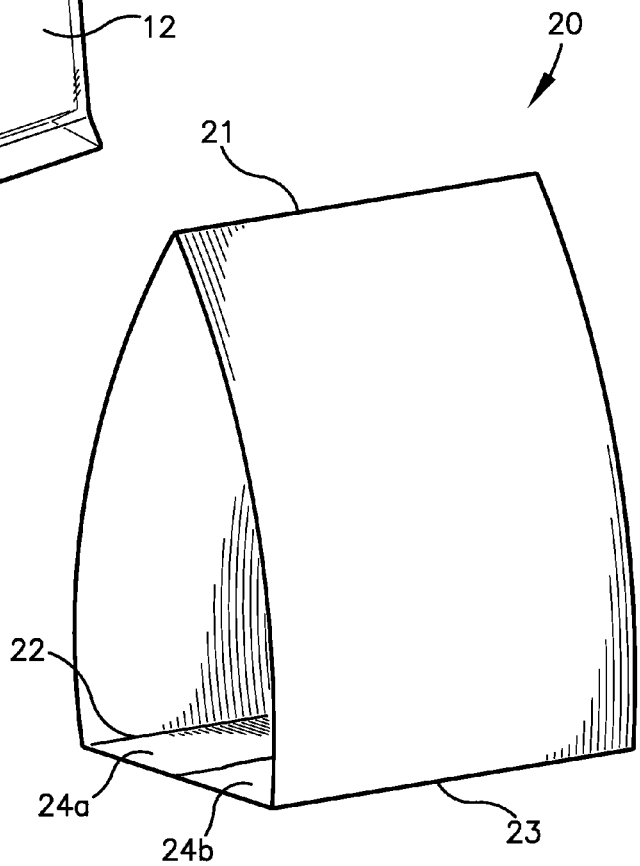
Fig. 2a (prior art)
FIG. 2*a* shows a perspective view of another PRIOR ART sign.

Detailed descriptions of various embodiments are set forth herein, with reference to the accompanying drawings, to enable those skilled in the art to practice the current invention. FIGS. 3*a* through 5 show a self-supporting sign 100 according to one embodiment of the present invention. The self-supporting sign 100 has a unitary construction of sheet 110 foldable about a single line 105 to distinguish a base portion 120 from an upwardly-extending portion 130 (also referred to herein as the upper portion 130).

Figure 4:
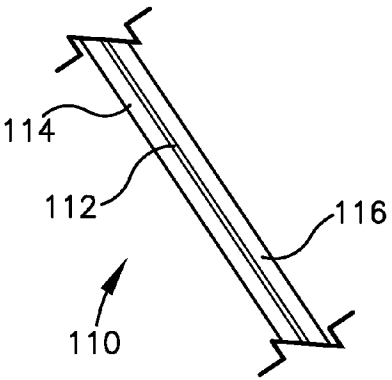
FIG. 4 shows a cross sectional view of a portion of the self-supporting sign of FIG. 3*a*.
Figure 5:
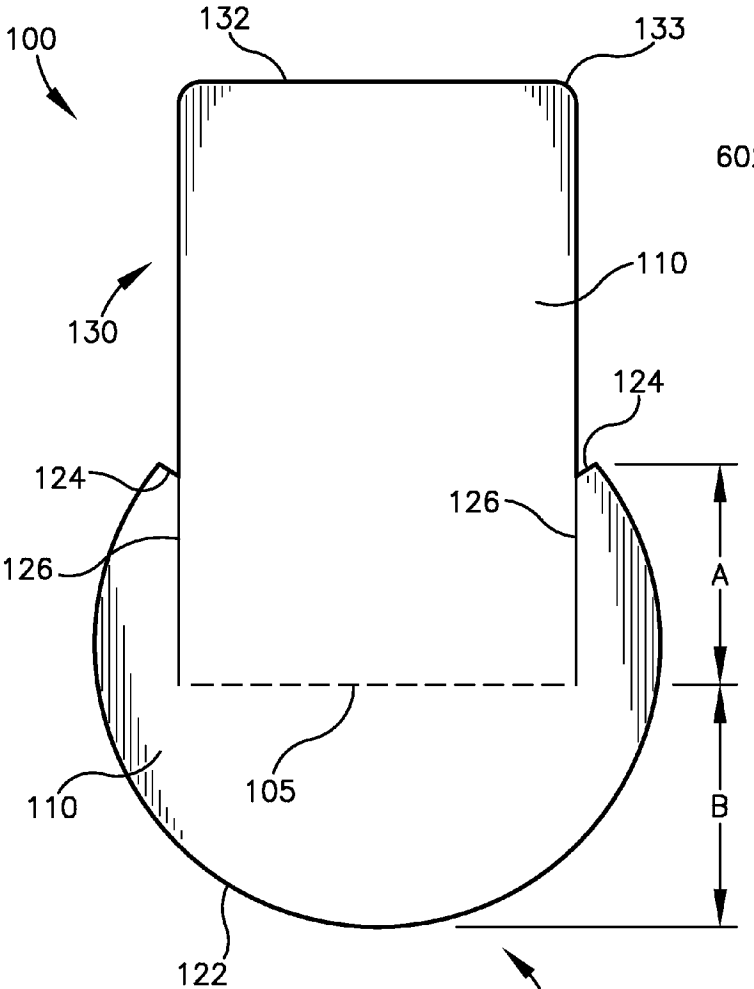
FIG. 5 shows a front view of the self-supporting sign of FIG. 3*a*, before the upper portion is folded relative to the base.

As shown in FIG. 4, the sheet 110 may include a primary layer 112, a first laminate layer 114, and a second laminate layer 116, such that the primary layer 112 is located between the laminate layers 114, 116. The primary layer 112 may be, for example, a synthetic printing substrate (e.g., the product marketed under the name Teslin® by PPG Industries of Monroeville, Pa.), a paper substrate, or any other appropriate foldable material. The laminate layer 114 and/or the laminate layer 116 may be, for example, 10 mil gloss laminate, or any other appropriate laminating material. Importantly, the primary layer 112 and the laminate layer(s) 114, 116 must collectively be sufficiently rigid such that the upper portion 130 remains in a raised position when the upper portion 130 is folded about the line 105 (FIG. 5). Though not shown in the figures, it may also be acceptable for multiple laminate layers 114, 116 to be used on either or both sides of the primary layer 112 (e.g., such that the sheet includes two laminate layers 114 coupled atop one another), and for multiple primary layers 112 to be included (e.g., adhered to one another). Especially if laminate layers 114, 116 are included, it may be desirable for indicia to be placed on the primary layer 112 (e.g., using a digital press or any other appropriate method) before the laminate 114, 116 is adhered to the primary layer 112.

Figure 3A:
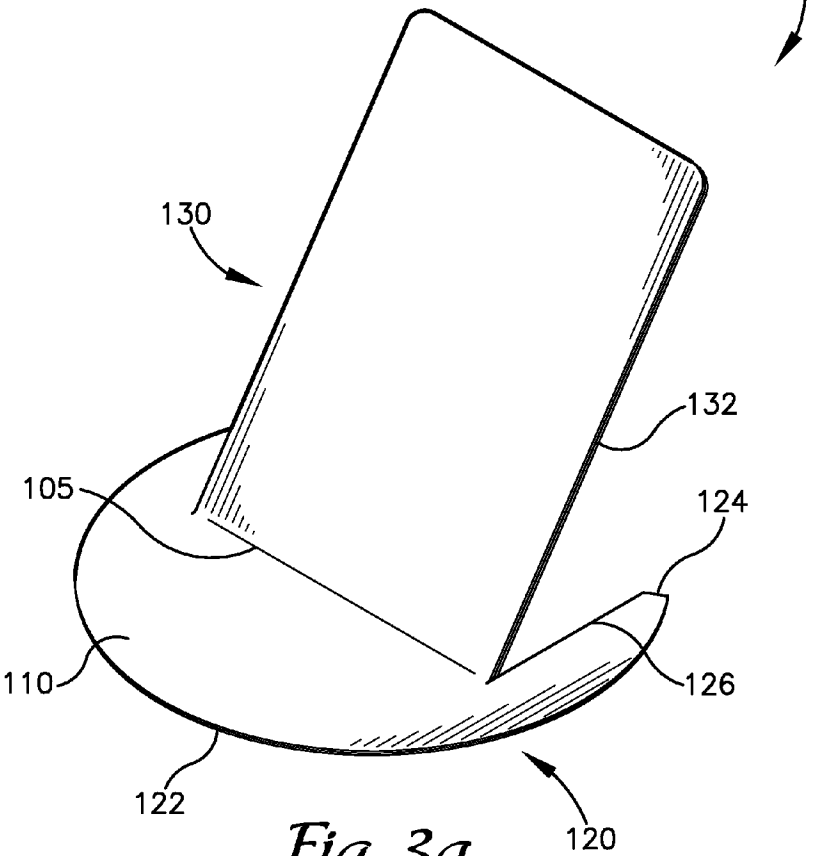
FIG. 3*a* shows a perspective view of a self-supporting sign according to an inventive embodiment, configured for use.
Figure 2B:
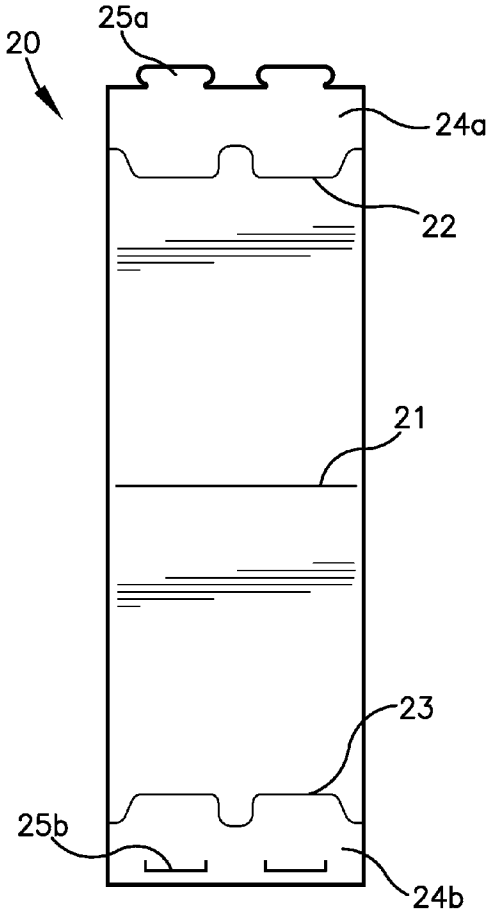
Fig. 2b (prior art)
FIG. 2*b* shows the PRIOR ART sign of FIG. 2 before being folded and secured.
Figure 3C:
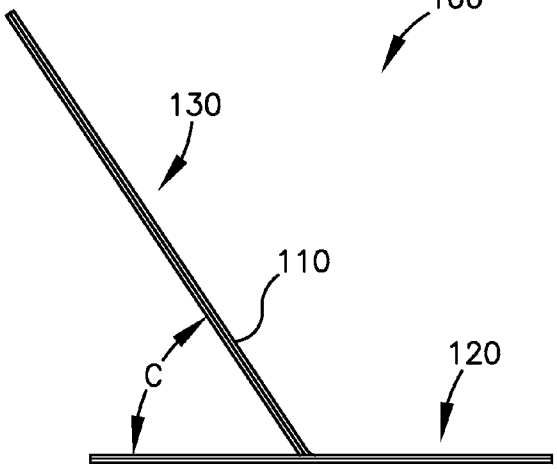
FIG. 3*c* shows a side view of the self-supporting sign of FIG. 3*a*.
Figure 3B:
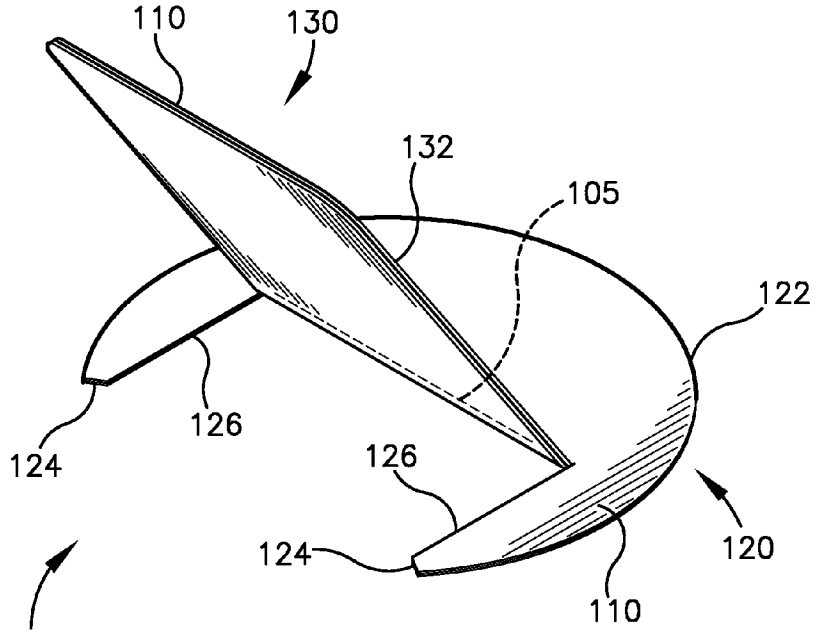
FIG. 3*b* shows another perspective view of the self-supporting sign of FIG. 3*a*.

While the base 120 may have various configurations (e.g., triangular, rectangular, etc.), it may be desirable for it to have a frusto-circular outer perimeter 122 with truncations 124 leading to internal lines 126, which in turn lead to the fold line 105, as shown in FIGS. 3*a*, 3*b*, and 5. The fold line 105 may be generally centered in the base 120 (i.e., such that distance A is generally equal to distance B in FIG. 5).

The upper portion 130 extends from the fold line 105 and may similarly have various configurations (e.g., rectangular, frusto-elliptical, or representative of a bird, animal, cross or other religious symbol, number, bell, or other object). The upper portion 130 shown in FIG. 5 has a generally rectangular outer perimeter 132 with rounded corners 133. FIG. 5 also shows a front view of the sign 100 before the upper portion 130 is folded relative to the base 120 about the fold line 105, and FIG. 3*c* illustrates the relationship of the upper portion 130 relative to the base 120 when in use (i.e., after the upper portion 130 is folded relative to the base 120).

Figure 6:
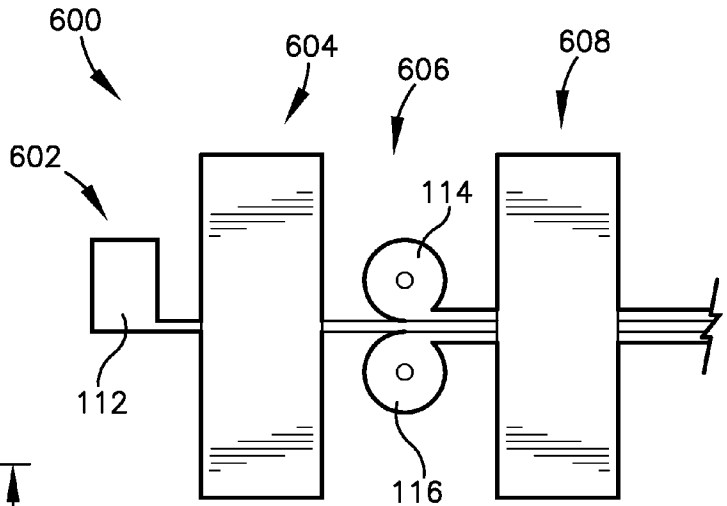
FIG. 6 shows a schematic representation of a manufacturing process for the self-supporting sign of FIG. 1.

FIG. 6 shows a schematic representation of a manufacturing process 600 for the self-supporting sign 100. At a first step 602, the primary layer 112 is provided (e.g., as a sheet or roll). The process 600 proceeds from step 602 to step 604.

At step 604, indicia is added to the primary layer 112 (i.e., to one side or both sides of the primary layer 112), such as through a digital press or any other appropriate method. It may be particularly important for any desired indicia to be added before the primary layer 112 is coupled to the laminate layers 114, 116, though indicia may be added in some embodiments after the primary layer 112 is coupled to the laminate layers 114, 116. The process 600 proceeds from step 604 to step 606.

At step 606, the laminate layers 114, 116 are coupled to the opposite sides of the primary layer 112, such as by pressure sensitive adhesive. The laminate layers 114, 116 may be obtained already having pressure sensitive adhesive, or pressure sensitive adhesive may otherwise be applied to the primary layer 112 and/or the laminate layers 114, 116. Though the adhesive is not shown in the drawings (e.g., in FIG. 4), those skilled in the art will appreciate that it is present nevertheless. The process 600 proceeds from step 606 to step 608.

At step 608, the primary layer 112 and the laminate layers 114, 116 are die cut, defining the self-supporting sign 100 (e.g., the perimeter 122, the truncations 124, the internal lines 126, the perimeter 132, and the corners 133). Simultaneously, or in a further step, the fold line 105 may be defined through pressure that does not cut through the sheet 110. In some embodiments, the fold line 105 may not be defined through the manufacturing process.

To use the self-supporting sign 100, then, the upper portion 130 is simply folded relative to the base 120 about the fold line 105 (FIG. 5). Once folded (FIGS. 3*a* through 3*c*), the upper portion 130 may remain generally stationary relative to the base 120. In some embodiments, the upper portion 130 may be offset from about 50° to about 90° from the base 120 (i.e., angle C in FIG. 3*c*), and more particularly from about 50° to about 65°. Unlike in the prior art, only a single fold is necessary, and there is no coupling of elements. And, before the upper portion 130 is folded relative to the base 120, the flat configuration (FIG. 5) may make the self-supporting sign 100 easy to store and/or ship. The upper portion 130 may also be re-folded to the flat configuration for storage when not in use.

Figure 7B:
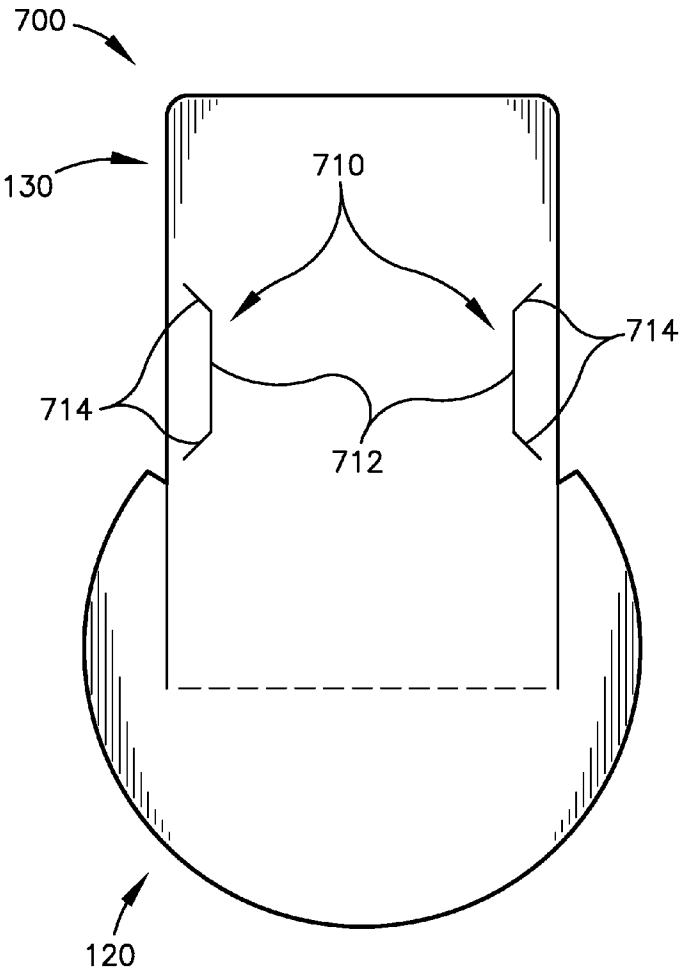
FIG. 7*b* shows a rear view of the self-supporting sign of FIG. 7*a*, before the upper portion is folded relative to the base.
Figure 7A:
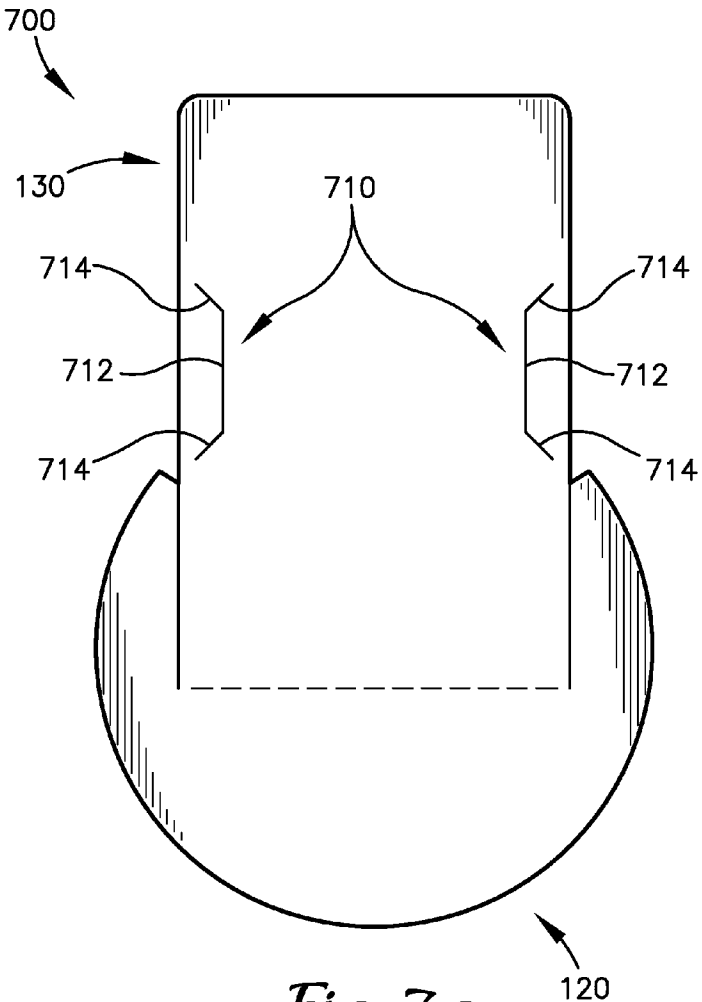
FIG. 7*a* shows a front view of a self-supporting sign according to another embodiment, before the upper portion is folded relative to the base.

FIGS. 7*a* and 7*b* show another self-supporting sign 700 that is substantially similar to the embodiment 100, except as specifically noted and/or shown, or as would be inherent. Further, those skilled in the art will appreciate that the embodiment 100 (and thus the embodiment 700) may be modified in various ways, such as through incorporating all or part of any of the various described embodiments, for example. For uniformity and brevity, corresponding reference numbers may be used to indicate corresponding parts, though with any noted deviations. In both FIG. 7*a* (front view) and FIG. 7*b* (rear view), the upper portion 130 is not yet folded relative to the base 120, as in FIG. 5.

In embodiment 700, a pair of opposed retaining members 710 are formed in the upper portion 130 such that a business card, flyer, advertisement, coupon, invitation, memo, announcement, pad of paper, or other item may be coupled to the upper portion 130 by being held between one or both of the retaining members 710. The retaining members 710 may for example be formed through a die cutting process (either at step 608 or another step) and may have a generally vertical portion 712 leading to angled portions 714 (as shown), or may be other shapes that allow the retaining function to be accomplished. While the retaining members 710 are shown to extend between one-fourth and one-third of the height of the upper portion 130, other dimension may also be appropriate.

Figure 8B:
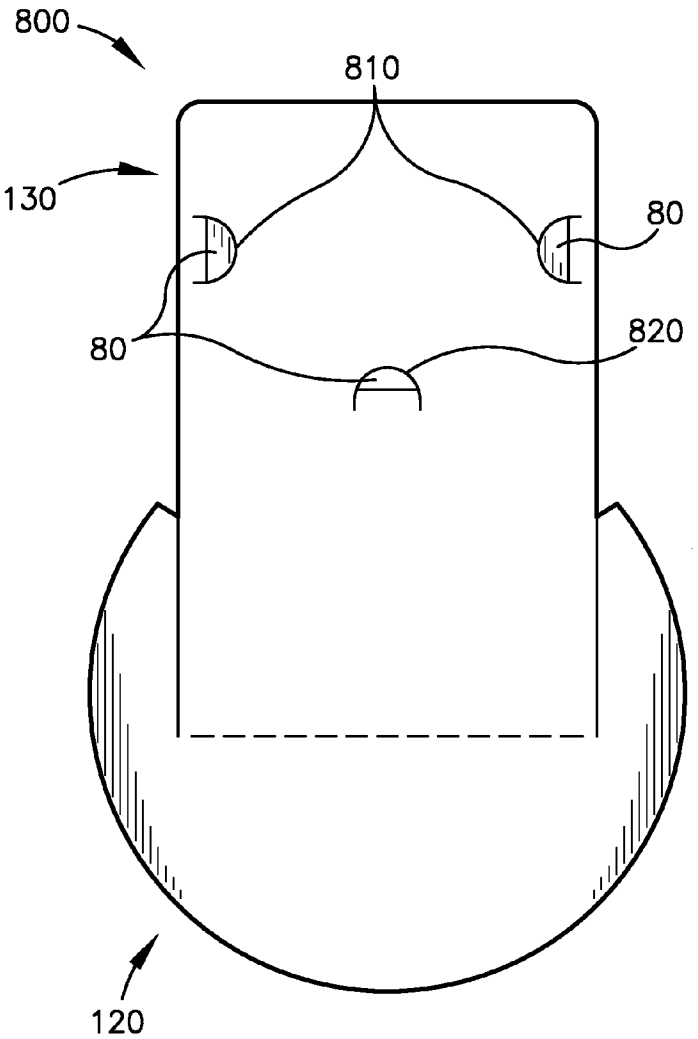
FIG. 8*b* shows a rear view of the self-supporting sign of FIG. 8*a*, before the upper portion is folded relative to the base, in use with a card.
Figure 8A:
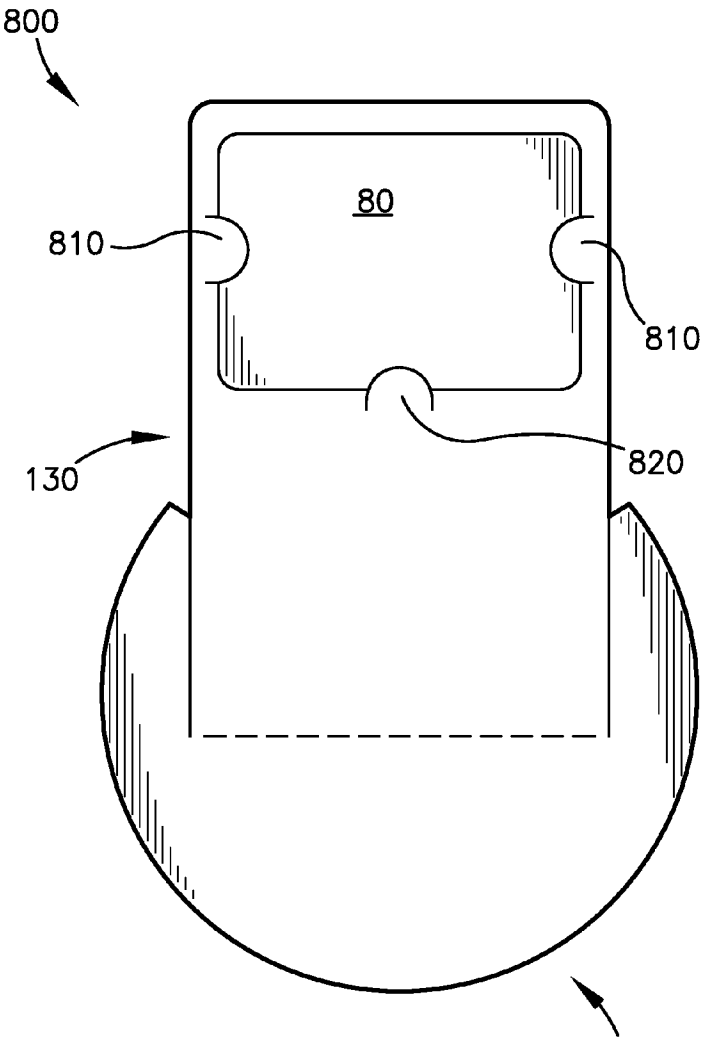
FIG. 8*a* shows a front view of a self-supporting sign according to still another embodiment, before the upper portion is folded relative to the base, in use with a card.

FIGS. 8*a* and 8*b* show another self-supporting sign 800 that is substantially similar to the embodiment 700, except as specifically noted and/or shown, or as would be inherent. Further, those skilled in the art will appreciate that the embodiment 700 (and thus the embodiment 800) may be modified in various ways, such as through incorporating all or part of any of the various described embodiments, for example. For uniformity and brevity, corresponding reference numbers may be used to indicate corresponding parts, though with any noted deviations. In both FIG. 8*a* (front view) and FIG. 8*b* (rear view), the upper portion 130 is not yet folded relative to the base 120, as in FIGS. 5, 7*a*, and 7*b*.

In embodiment 800, the pair of opposed retaining members 710 is replaced with a pair of retaining members 810 that are similarly formed in the upper portion 130 such that a business card, flyer, advertisement, coupon, invitation, memo, announcement, pad of paper, or other item may be coupled to the upper portion 130 by being held between one or both of the retaining members 810. The retaining members 810 may for example be formed through a die cutting process (either at step 608 or another step) and may be generally rounded (as shown), or may be other shapes that allow the retaining function to be accomplished. The illustrated shapes are the primary difference between the retaining members 710 and the retaining members 810. Embodiment 800 further includes a lower retaining member 820 for providing additional retaining support. A card 80 is shown coupled to the upper portion 130 by being restrained between the retaining members 810 and the lower retaining member 820.

Figure 9:
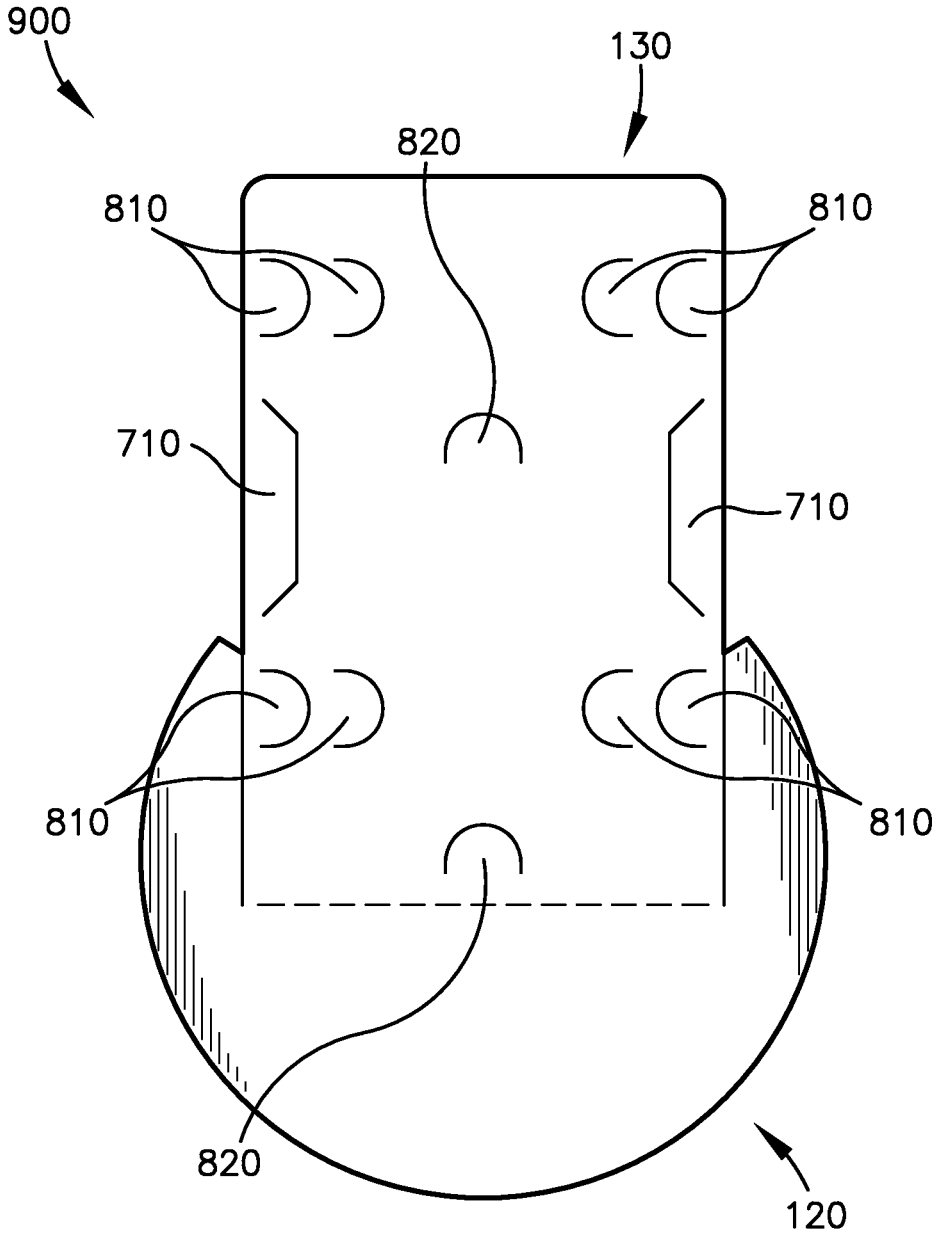
FIG. 9 shows a front view of a self-supporting sign according to still yet another embodiment, before the upper portion is folded relative to the base.

FIG. 9 shows another self-supporting sign 900 that is substantially similar to the embodiment 800, except as specifically noted and/or shown, or as would be inherent. Further, those skilled in the art will appreciate that the embodiment 800 (and thus the embodiment 900) may be modified in various ways, such as through incorporating all or part of any of the various described embodiments, for example. For uniformity and brevity, corresponding reference numbers may be used to indicate corresponding parts, though with any noted deviations. In FIG. 9, the upper portion 130 is not yet folded relative to the base 120, as in FIGS. 5, 7*a*, 7*b*, 8*a*, and 8*b*.

Embodiment 900 primarily differs from the embodiment 800 by including multiple pairs of the retaining members 810, multiple lower retaining members 820, and also a pair of the retaining members 710. The retaining members 710, 810, 820 are spaced along the upper portion 130 to provide various spacing for restraining objects of different sizes.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. Further, it will be understood that certain features and subcombinations are of utility and may be employed without reference to other features and subcombinations and are contemplated within the scope of the claims. Further, various steps set forth herein may be carried out in orders that differ from those set forth herein without departing from the scope of the present methods. The description should not be restricted to the above embodiments, but should be measured by the following claims.

We claim:

1. A self-supporting sign, comprising a unitary sheet having a generally planar base portion and a generally planar upper portion; the base portion having front and rear ends; the upper portion being foldable relative to the base portion about a fold line; the unitary sheet being sufficiently rigid such that when the upper portion is folded relative to the base portion about the fold line, the sign remains at a use configuration in which the base portion is generally horizontal and the upper portion is raised relative to the base portion; only the single fold about the fold line being necessary to move the sign from a generally planar configuration to the use configuration; the fold line being between the base portion front and rear ends such that the single fold about the fold line causes the upper portion to move toward the base portion front end and away from the base portion rear end; the upper portion being offset from the base portion between about 50° and 90° when at the use configuration;

wherein the unitary sheet comprises a primary layer coupled to a first laminate layer and a second laminate layer, the primary layer being between the first and second laminate layers;

wherein the primary layer includes a synthetic printing substrate, the first laminate layer includes 10 mil laminate, and the second laminate layer includes 10 mil laminate; and wherein the base portion has a frusto-circular outer perimeter with truncations leading to internal lines which in turn lead to the fold line.

2. The self-supporting sign of claim 1, wherein the upper portion extends from the fold line and has a generally rectangular outer perimeter.

3. The self-supporting sign of claim 2, wherein the fold line is generally centered in the base portion.

4. The self-supporting sign of claim 2, wherein the upper portion is offset from the base portion between about 50° and 65° when at the use configuration.

5. The self-supporting sign of claim 1, wherein the upper portion is offset from the base portion between 50° and 65° when at the use configuration.

6. A self-supporting sign, comprising a unitary sheet having a generally planar base portion and a generally planar upper portion; the base portion having front and rear ends; the upper portion being foldable relative to the base portion about a fold line; the unitary sheet being sufficiently rigid such that when the upper portion is folded relative to the base portion about the fold line, the sign remains at a use configuration in which the base portion is generally horizontal and the upper portion is raised relative to the base portion; only the single fold about the fold line being necessary to move the sign from a generally planar configuration to the use configuration; the fold line being between the base portion front and rear ends such that the single fold about the fold line causes the upper portion to move toward the base portion front end and away from the base portion rear end; the upper portion being offset from the base portion between about 50° and 90° when at the use configuration;

wherein the base portion has a frusto-circular outer perimeter and internal lines leading to the fold line, the internal lines being in communication with a point on the frusto-circular outer perimeter before the upper portion is folded relative to the base portion; and wherein the upper portion extends from the fold line.

7. The self-supporting sign of claim 6, wherein: truncations in the frusto-circular outer perimeter lead to the internal lines which in turn lead to the fold line.

8. A self-supporting sign, comprising:

a generally planar base portion; and a generally planar upper portion extending from the base portion; the upper portion being foldable relative to the base portion about a fold line for movement between a storage configuration in which the base and upper portions are generally coplanar and a use configuration in which the base portion is generally horizontal and the upper portion is raised relative to the base portion; the base and upper portions being sufficiently rigid such that the upper portion remains at the use configuration after being moved to the use configuration; the upper portion being offset from the base portion between about 50° and 90° when at the use configuration;

wherein the base portion and the upper portion each define respective portions of an external perimeter of the sign when at the storage configuration; and wherein the base portion and the upper portion are formed in a unitary sheet, the unitary sheet comprising material selected from the group consisting of paper and a synthetic printing substrate.

9. The self-supporting sign of claim 8, wherein the fold line is generally centered in the base portion.

10. The self-supporting sign of claim 9, wherein:

the base portion has an outer perimeter with truncations leading to internal lines which in turn lead to the fold line;

the upper portion extends from the fold line and has an outer perimeter; and the base portion internal lines are adjacent the upper portion when the upper portion is at the storage configuration and spaced apart from the upper portion when the upper portion is at the use configuration.

11. The self-supporting sign of claim 10, wherein the upper portion includes:

a pair of opposed retaining members for removably coupling an item to the upper portion, the opposed retaining members being defined by separation in the upper portion; and a lower retaining member for removably coupling an item to the upper portion, the lower retaining member being defined by separation in the upper portion.

12. The self-supporting sign of claim 8, wherein the upper portion includes a retaining member for removably coupling an item to the upper portion, the retaining member being defined by separation in the upper portion.

13. The self-supporting sign of claim 8, wherein the upper portion includes a plurality of retaining members spaced apart for removably coupling items having different dimensions to the upper portion, the retaining members being defined by separation in the upper portion.

14. A self-supporting sign, comprising a unitary sheet having a generally planar base portion and a generally planar upper portion; the upper portion being foldable relative to the base portion about a fold line; the unitary sheet being sufficiently rigid such that when the upper portion is folded relative to the base portion about the fold line, the sign remains at a use configuration in which the base portion is generally horizontal and the upper portion is raised relative to the base portion; the fold line separating the base into an area forward of the upper portion and an area rearward of the upper portion when the sign is at the use configuration; the upper portion being offset from the base portion between about 50° and 90° when at the use configuration; the upper portion and the base portion each defining a portion of an external perimeter when the sign is at a generally planar configuration.

15. The self-supporting sign of claim 14, wherein the upper portion is offset from the base portion between 50° and 65° when at the use configuration.

16. The self-supporting sign of claim 14, wherein the upper portion includes:

a pair of opposed retaining members for removably coupling an item to the upper portion, the opposed retaining members being defined by separation in the upper portion; and a lower retaining member for removably coupling an item to the upper portion, the lower retaining member being defined by separation in the upper portion.

17. The self-supporting sign of claim 14, wherein the upper portion includes a retaining member for removably coupling an item to the upper portion, the retaining member being defined by separation in the upper portion.

18. The self-supporting sign of claim 14, wherein the upper portion includes a plurality of retaining members spaced apart for removably coupling items having different dimensions to the upper portion, the retaining members being defined by separation in the upper portion.

* * * * *